US007287929B1

(12) United States Patent
Sokolowski et al.

(10) Patent No.: US 7,287,929 B1
(45) Date of Patent: Oct. 30, 2007

(54) SMART BOLLARD

(75) Inventors: John C. Sokolowski, Wilkes-Barre, PA (US); William J. Peiffer, Moline, IL (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 11/272,427

(22) Filed: Nov. 9, 2005

Related U.S. Application Data

(60) Provisional application No. 60/627,809, filed on Nov. 10, 2004.

(51) Int. Cl.
*E01F 13/02* (2006.01)
*E01F 15/00* (2006.01)

(52) U.S. Cl. ..... 404/6; 49/49

(58) Field of Classification Search ..... 404/9, 404/10, 11; 49/49
See application file for complete search history.

(56) References Cited

U.S. PATENT DOCUMENTS 4,578,586 A * 3/1986 Preston ..... 250/382
4,638,443 A * 1/1987 Kaneyasu et al. ..... 702/24
4,666,332 A 5/1987 Burgett
4,943,929 A * 7/1990 Simonoff ..... 700/266
5,007,763 A 4/1991 Burgett
5,597,262 A * 1/1997 Beavers et al. ..... 404/6
5,829,913 A 11/1998 Puckett
6,293,861 B1 * 9/2001 Berry ..... 454/255
6,485,224 B1 11/2002 Dyke et al.
6,692,694 B1 * 2/2004 Curry et al. ..... 422/28

OTHER PUBLICATIONS

US Army Technical Manual TM 3-6665-316-12; Issue Date: Dec. 1, 1987; Operator's and Unit Maintenance Manual, Detector Unit, Chemical Agent Automatic Alarm, M8A1.*

* cited by examiner

*Primary Examiner*—Raymond W Addie
(74) *Attorney, Agent, or Firm*—Michael Zelenka; George B. Tereschuk

(57) ABSTRACT

A smart bollard includes a compartment wherein a smart bollard circuit may be located and the smart bollard circuit, in turn, includes at least one processor, a transceiver that may be connected in circuit with the processor and configured to communicate with a central control station in response to commands from the processor, at least one sensor provided for sensing for the presence of one or more airborne agents and at least one disinfection unit that is configured for receiving commands from the processor to effect a selected disinfection of a perimeter area about the bollard sleeve. Also, the processor may be configured to receive input from the at least one sensor concerning the presence of one or more airborne agents, analyze the input and provide commands to the at least one disinfection unit to effect a selected disinfection, and to communicate the presence of one or more airborne agents to the central control station via the transceiver. A method of response to a terrorist attack using the foregoing apparatus is also presented.

11 Claims, 4 Drawing Sheets

SMART BOLLARD

CROSS REFERENCE TO RELATED APPLICATION

This application claims the benefit of U.S. Provisional Patent Application Ser. No. 60/627,809, entitled "Smart Bollard" and filed Nov. 10, 2004, which is fully incorporated herein by reference herein.

GOVERNMENT INTEREST

The invention described herein may be manufactured, used, imported, sold, and licensed by or for the Government of the United States of America without the payment of any royalty thereon or there for.

BACKGROUND OF THE INVENTION

1. Field of the Invention

The present invention relates generally to devices and methods for protecting people in, or adjacent to, buildings from a terrorist attack and, more particularly, to safety posts or bollards which may be located adjacent a building.

2. Related Art

Safety posts or bollards, are well known for preventing out of control automobiles from entering a pedestrian zone and causing injury and for preventing out of control automobiles from damaging buildings. Typically, bollards comprise a metal pipe having cement poured and hardened in the bore of the pipe for strengthening and fixing of the bollard to the earth. Also, a cap may be attached to the bollard to house a security sensor. For example, U.S. Pat. No. 5,829,913 describes a bollard cap that includes a dome and a sleeve having transparent strips and extending from the dome. Within the volume covered by the dome and the sleeve may be located motion detectors, optical detectors or a camera and a sensor control box. This bollard cap provides a minimal security system for buildings, parking lots, etc.

SUMMARY OF THE INVENTION

In accordance with an embodiment of the present invention, an apparatus, comprises at least one bollard that comprises a compartment wherein smart bollard circuit may be located and the smart bollard circuit comprises at least one processor, a transceiver that may be connected in circuit with the processor and configured to communicate with a central control station in response to commands from the processor, at least one sensor connected in circuit with the processor and provided for sensing for the presence of one or more airborne agents and at least one disinfection unit connected in circuit with the processor and that is configured for receiving commands from the processor to effect a selected disinfection of a perimeter area about the bollard sleeve. Also, the processor may be configured to receive input from the at least one sensor concerning the presence of one or more airborne agents, analyze the input and provide commands to the at least one disinfection unit to effect a selected disinfection, and to communicate the presence of one or more airborne agents to the central control station via the transceiver.

BRIEF DESCRIPTION OF THE DRAWINGS

The following detailed description is made with reference to the accompanying drawings, in which.

DETAILED DESCRIPTION OF THE PREFERRED EMBODIMENT

One embodiment of the present invention concerns a device and a method for ameliorating the effects of a terrorist attack adjacent a location such as a building. In one particular embodiment, a bollard comprises a smart bollard circuit which may provide for the sensing of, e.g., airborne agents, for the disinfection of those agents and for the communication of that information to a central control station. A plurality of bollards may be provided to cover a particular area and each may be in communication with the central control station.

Figure 1:
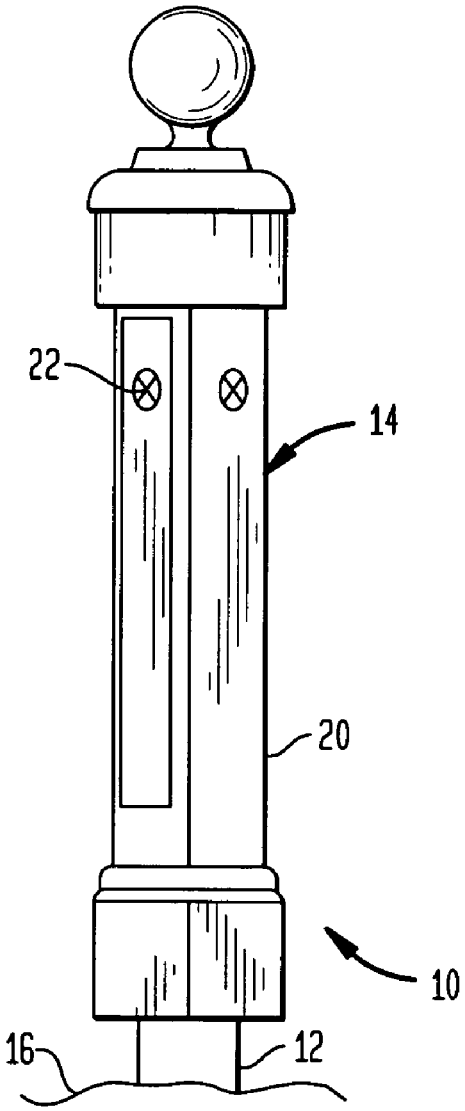
FIG. 1 is a perspective view of a smart bollard in accordance with an embodiment of the present invention.
Figure 2:
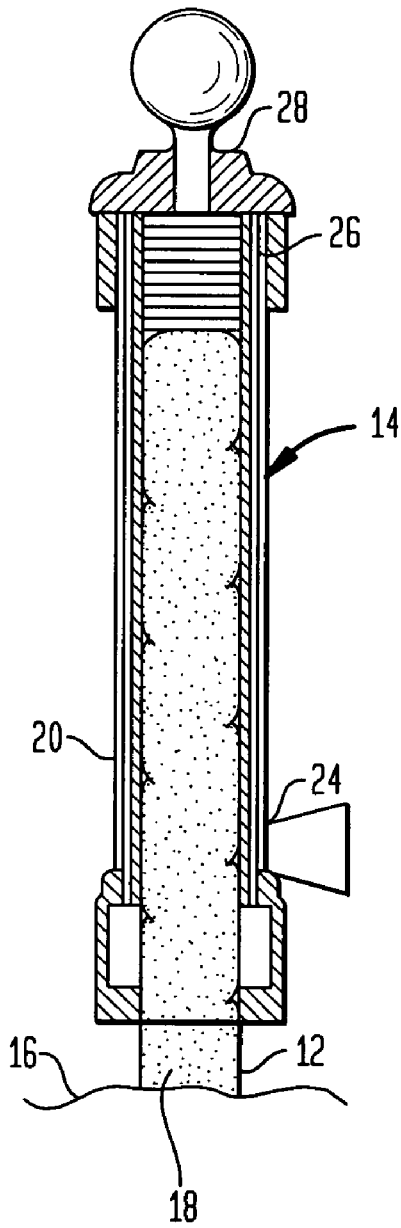
FIG. 2 is a partial cross-sectional view of the smart bollard of FIG. 1.

Referring to FIGS. 1 and 2, a smart bollard in accordance with one embodiment of the present invention is illustrated generally at 10. In this embodiment, the smart bollard 10 may comprise a bollard tube such as a pipe 12 and a bollard sleeve 14. The pipe 12 may be fixed to the earth 16 in a known manner using, for example, concrete 18. The bollard sleeve 14 may comprise a generally cylindrical configuration which is dimensioned to fit over the pipe 12 and, an outer surface 20, may be decorated with ornaments 22. In addition, the bollard sleeve 14 may include an architectural configuration that, along with the ornaments 22, provides a pleasing outer appearance. A curb light 24 may also be provided. Further, the bollard sleeve 14 may comprise a housing or a compartment 26 and a removable cap 28. Although located at one end (not numbered) of the sleeve 14, it will be understood that the location of the compartment 26 within the sleeve may be varied. As illustrated, the removable cap 28 may provide easy access to the compartment 26.

Figure 3:
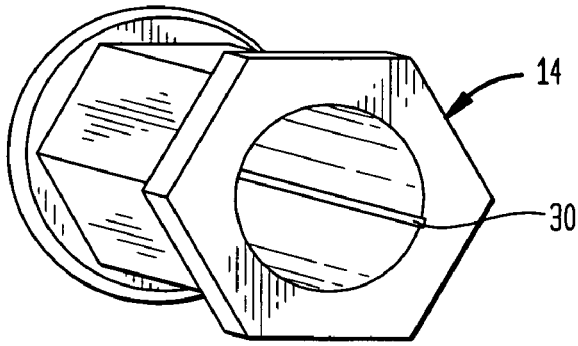
FIG. 3 is a perspective view of one end of a bollard sleeve of the smart bollard of FIG. 1.

Referring now also to FIG. 3, the bollard sleeve 14 may comprise a channel 30, which may extend to the compartment 26 and, along which electrical and/or communication wires (not shown) may extend.

Figure 4:
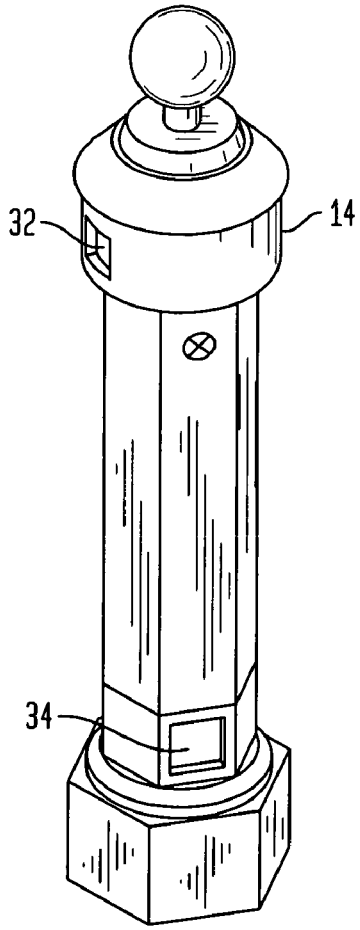
FIG. 4 is another perspective view of the smart bollard of FIG. 1.

As illustrated in FIG. 4, the bollard sleeve 14 may comprise one or more openings 32 that may communicate with the compartment 26 (FIG. 2). The opening 32 may comprise a movable door or cover (not shown) for providing selective access to the compartment 26, the utility of which will be more apparent below. Another opening 34 may be provided in the bollard sleeve 14 for a light to shine on the streetscape or for the spraying of an disinfectant.

Figure 6:
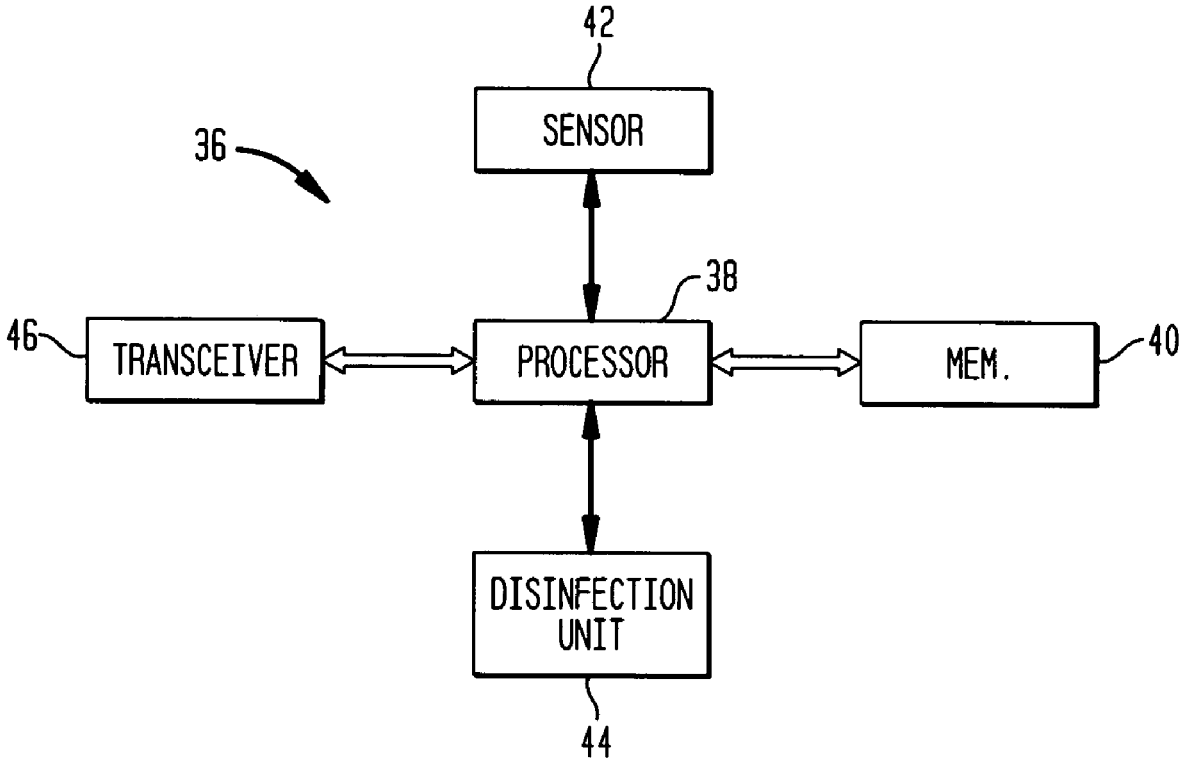
FIG. 6 is a block diagram showing one embodiment of a smart bollard circuit in accordance with an important feature of the present invention.

Referring now to FIG. 6, a smart bollard circuit 36, which may be located within the compartment 26, is shown. The smart bollard circuit 36 may comprise a processor 38 and an associated memory unit 40, a sensor 42, a disinfection unit 44 and a transceiver 46. The processor 38, in association with the memory unit 40, may be configured to receive input, process and provide output to each of the sensor 42, the disinfection unit 44 and the transceiver 46 and comprises appropriate software or firmware to perform each of the functions/operations described in more detail hereafter.

The sensor 42 may comprise any suitable device that is currently available, or hereafter developed, which may function to monitor for and identify airborne agents, including any harmful vapors, such as nerve, blister and blood agents. One example of a suitable device that that is available is that sold under the mark "ChemSentry" owned by BAE Systems and found on the World Wide Web at http://www.baesystems.com. The sensor 42 functions to sense for airborne agents in proximity to the bollard 10 and, upon sensing any, to provide input such as the particular airborne agent sensed, the strength of the agent and opportunistic quantity feasible to disinfect to the processor 38. To function as described, it will be appreciated that the sensor 42 should be located to receive, and the compartment and opening 32 configured to communicate and provide through wind or otherwise such as by fan, a continuous ingress of air from that surrounding the bollard 10.

The disinfection unit 44 is configured to receive input which may be in the form of commands from the processor 38 concerning a particular airborne agent sensed by the sensor 42 and to provide a responsive action. In the case of a biological agent, such as a pathogenic micro-organism, the disinfection unit 44 may be configured to provide an antiseptic response such as a bactericide, algicide, fungicide, sporicide and virucide. To achieve this, the disinfection unit 44 may comprise a jet sprayer (not shown) for vaporizing micro droplets on the order of five to fourteen micrometers in diameter of liquid into the air. It will be appreciated that the disinfection unit 44 may be located adjacent the opening 32 (or multiple openings 32 about the periphery of the bollard 10) in order to provide an effective antiseptic response in proximity to the bollard 10. It will be understood that disinfection unit 44 may contain an atomizer that may operate to disperse micro sized particles up to a distance of about twenty meters from the bollard 10. One example of a disinfection unit that is suitable for use in connection with the present invention is sold under the mark ASEPTOJET, along with a disinfectant liquid that is sold under the mark ASEPTOSYL, both of which are available from the Aquateigna Corporation and may be found on the World Wide Web at http://www.aquateigna.com.

The transceiver 46 may comprise a wired and/or wireless system and may be connected to receive commands from the processor 38 for communication between the smart bollard circuit 36 and a central control station and/or other bollards as described below. The transceiver 46 may comprise a known secure digital communication system, capable of encryption, to prevent security breaches in the system.

In operation, the processor 38 may be programmed, through software or firmware, to communicate with the sensor 42 to receive input as to the presence of one or more particular airborne agents. The processor 38 may then associate a particular command with that agent and then may communicate that command to the disinfection unit 44 for providing an appropriate response to the particular agent such as vaporizing a particular antiseptic.

Figure 5:
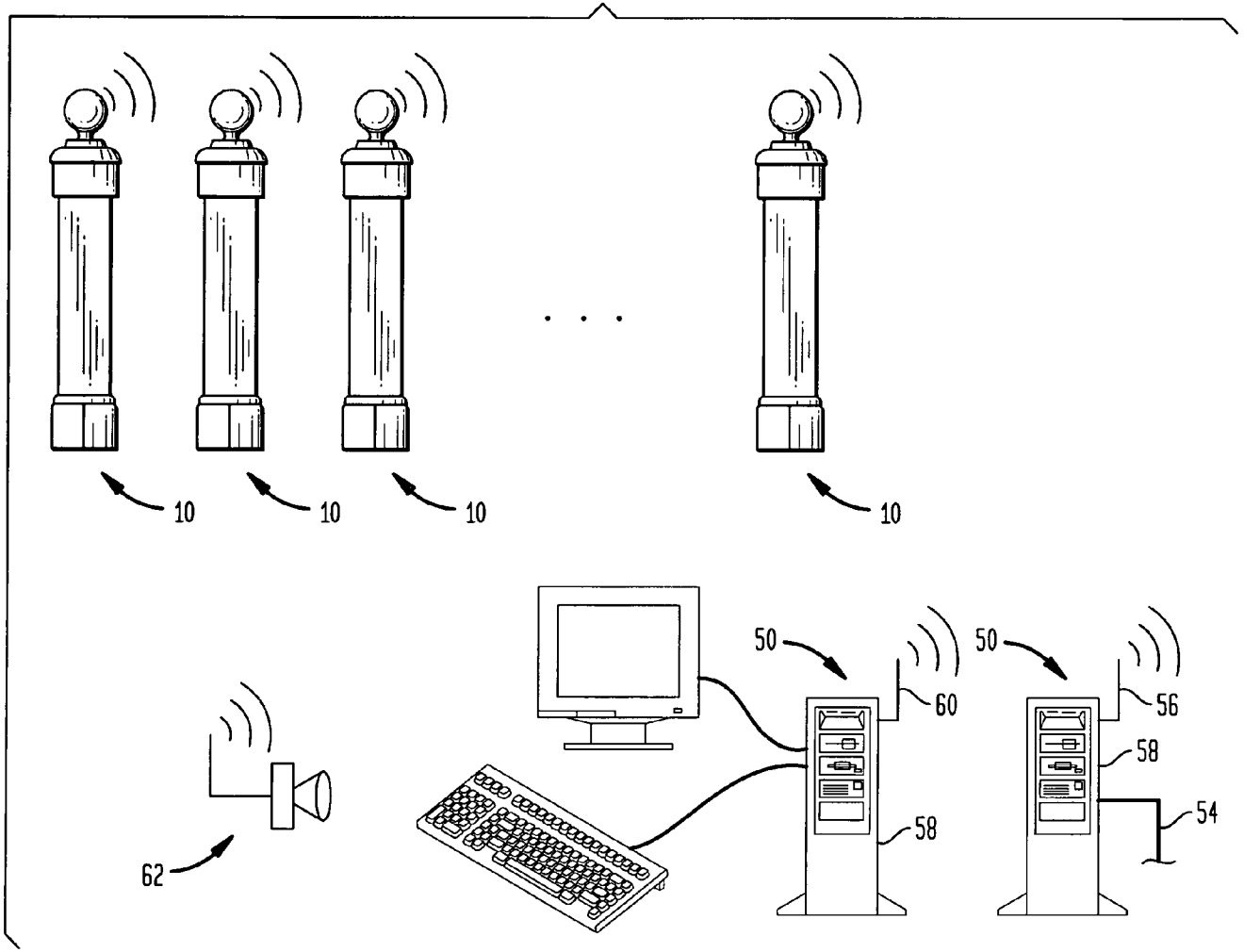
FIG. 5 is a diagram showing multiple smart bollards in communication with a central control system in accordance with another aspect of the present invention.

Referring now to FIGS. 5 and 6 and in another aspect of the present invention, multiple bollards 10, which may be located approximately four to five feet apart and disposed about the periphery of a building (not shown), may each communicate with a central control station 50. The central control station 50 may comprise a local area network router and firewall connected via a wire 54 to the Internet and optionally through wireless communication antenna 56 to the bollards 10 and/or one or more computers 58 via antenna 60. It will be understood that rather than wireless communication, fully wired communications may be employed, depending upon security requirements. Also, it will be understood that computer 58 may be portable and may be in the form of a laptop or palm top computer capable of communicating with the router and firewall via, e.g., wireless or the internet. In this aspect of the present invention, the central control station 50 may be in constant communication with each processor 38 of each bollard 10. Upon any sensor 42 of any bollard 10 sensing an airborne agent, the central control station 50 may be configured to receive such an indication and identification of which bollard 10 has sensed the agent, store the particulars of the airborne agent for future use and may communicate to bollards in close proximity to provide commands to each disinfection unit thereof for also providing an appropriate disinfection action.

The smart bollard circuit 36 may also include one or more video cameras (not shown) connected in circuit with the processor 38 which may provide a signal to the transceiver 46 for visual assessment by an operator located, e.g., at the central control station. The visual assessment affords a central control station operator to take further response actions and direct responders to the scene in a safe manner. Additionally, a central control station operator may activate additional adjacent disinfection units 44 if needed to contain the spread of the noxious substance or once depletion of the initially activated disinfection units occurs. A suitable central control station with visual assessment and automatic and manual response capability is available from EPS Security Solutions, Inc. on the World Wide Web at http://www.epscorp.com.

Optionally, the central control station 50 may comprise an emergency mass notification device such as an audible alarm system 62 for notifying local personnel of the detection of an airborne agent. Another suitable central control station with an audible alarm system is available from Wheelock, Inc on the World Wide Web at http://www.wheelockinc.com. Other emergency mass notification devices suitable for use in accordance with the present invention also may be obtained at the preceding web site.

In accordance with another embodiment of the present invention, a method of responding to a terrorist attack in proximity to a building or other inhabited area may comprise modifying a bollard and providing a central control station both of which may be employed to accomplish the following steps. First, the bollard must be capable of collecting samples of air for analysis and to detect and broadly characterizing contents of a sample as an airborne agent. Thereafter, to provide a presumptive identification of a particular suspected biochemical airborne agent. Further, to notify personnel of the potential detection of an airborne agent and to provide a countermeasure such as by spraying chemicals to reduce or eliminate the airborne agents.

While the present invention has been described in connection with what are presently considered to be the most practical and preferred embodiments, it is to be understood that the present invention is not limited to these herein disclosed embodiments. Rather, the present invention is intended to cover all of the various modifications and equivalent arrangements included within the spirit and scope of the appended claims.

What is claimed is:

1. A real-time, secure, smart contaminant detection network comprising:

a smart contamination detecting circuit comprising a plurality of smart circuit components including a processor, a memory unit, a transceiver, an airborne contamination sensor and a means for disinfecting, all being connected to a portable central control station through wireless communications;

a bollard tube, having a central cavity, is fixedly positioned in the ground and a bollard sleeve, having a secure compartment, and a plurality of apertures, covers said bollard tube;

said secure compartment protects said circuit and allows said sensor to continuously monitor an area of interest without tampering;

said transceiver, being coupled to said processor, responds to said processor and communicates with said control station;

said sensor, being coupled to said processor, detects a plurality of airborne contaminants in said area and provides a sensor input to said processor through said transceiver;

said sensor input further comprising an identification of an airborne agent, a measure of airborne agent potency and a type and quantity of disinfectant needed;

a multitude of said covered bollard tubes being connected to said circuit and said network are deployed in said area; and said processor, cooperating with said memory unit, receives, analyzes and processes said sensor input and commands said disinfecting means to select a group of disinfectants to disinfect said area in real-time and an audible alarm system is activated by a communication from said control station with a control station transceiver.

2. The real-time, secure, smart contaminant detection network, as recited in claim 1, further comprising said audible alarm system comprises at least one of an emergency mass notification appliance, a restricted area alert system, a personnel alert system and a deployable restricted area alert system.

3. The real-time, secure, smart contaminant detection network, as recited in claim 1, further comprising said sensor senses for at least one of a blood agent, a blister agent and a nerve chemical vapor.

4. The real-time, secure, smart contaminant detection network, as recited in claim 1, further comprising:

said bollard tube is a pipe filled with concrete;

said bollard sleeve having a generally cylindrical outer configuration that is dimensioned to fit over said bollard tube;

said secure compartment is located at one end of said bollard sleeve, said secure compartment communicating with at least one opening for access by said sensor and said disinfecting means; and further comprising:

at least one channel extending longitudinally along an inner surface of said bollard sleeve being dimensioned to accommodate at least one of a power cord and a communication line.

5. The real-time, secure, smart contaminant detection network, as recited in claim 4, further comprising said bollard tube having a cap which removably covers said secure compartment.

6. A method for detecting airborne contaminants in real-time with a secure, smart airborne contaminant detection network comprising the steps of:

providing a plurality of smart circuit components including a processor, a memory unit, a transceiver, an airborne contamination sensor and a means for disinfecting;

connecting said plurality of smart circuit components to provide a smart contamination detecting circuit;

coupling said circuit to a portable central control station;

forming a bollard tube with a central cavity;

covering said bollard tube with a bollard sleeve, said bollard sleeve having a secure compartment and a plurality of apertures;

fixedly positioning said covered bollard tube in the ground;

placing said circuit in said secure compartment to protect said plurality of smart circuit components from tampering and to allow said sensor to continuously monitor an area of interest;

coupling said transceiver to said processor, said transceiver being configured to respond to said processor and communicate with said control station;

coupling said sensor to said processor;

connecting said disinfecting means to said processor to receive commands from said processor;

deploying a multitude of covered bollard tubes in said area;

monitoring said area continuously with said sensor to detect a plurality of airborne contaminants;

providing a sensor input to said processor through said transceiver, said sensor input further comprising an identification of an airborne agent, a measure of airborne agent potency and a type and quantity of disinfectant needed;

connecting said multitude of covered bollard tubes to said circuit and said network;

receiving said sensor input in said processor;

analyzing and processing said sensor input by said processor in cooperation with said memory unit;

providing a control station transceiver for said control station to communicate with said circuit; and sending a command from said processor to said disinfecting means to select a group of disinfectants to disinfect said area in real-time and activate an audible alarm system that is initiated by a communication from said control station transceiver to said control station.

7. The method for detecting airborne contaminants in real-time with the secure, smart airborne contaminant detection network, as recited in claim 6, wherein said audible alarm system comprises at least one of an emergency mass notification appliance, a restricted area alert system, a personnel alert system and a deployable restricted area alert system.

8. The method for detecting airborne contaminants in real-time with the secure, smart airborne contaminant detection network, as recited in claim 7, further comprising the step of configuring said sensor to detect for at least one of a blood agent, a blister agent and a nerve chemical vapor.

9. The method for detecting airborne contaminants in real-time with the secure, smart airborne contaminant detection network, as recited in claim 6, further comprising the steps of:

forming said bollard tube from a pipe filled with concrete;

forming said bollard sleeve in a generally cylindrical outer configuration that is dimensioned to fit over said bollard tube;

locating said secure compartment at one end of said bollard sleeve, said secure compartment communicating with at least one opening for access by said sensor and said disinfecting means; and longitudinally extending at least one channel along an inner surface of said bollard sleeve dimensioned to accommodate at least one of a power cord and a communication line.

10. The method for detecting airborne contaminants in real-time with the secure, smart airborne contaminant detection network, as recited in claim 9, further comprising the step of forming said bollard tube with a cap which removably covers said secure compartment.

11. A method of responding to a terrorist attack by airborne contaminants in proximity to a building or other inhabited area with a real-time, secure, smart airborne contaminant detection network housed in covered bollard tubes, comprising the steps of:

providing a plurality of smart circuit components including a processor, a memory unit, a transceiver, an airborne contamination sensor and a means for disinfecting;

connecting said plurality of smart circuit components to provide a smart contamination detecting circuit;

coupling said circuit to a portable central control station;

forming a bollard tube with a central cavity;

covering said bollard tube with a bollard sleeve, said bollard sleeve having a secure compartment and a plurality of apertures;

fixedly positioning said covered bollard tube in the ground;

placing said circuit in said secure compartment to protect said plurality of smart circuit components from tampering and to allow said sensor to continuously monitor an area of interest;

coupling said transceiver to said processor, said transceiver being configured to respond to said processor and communicate with said control station;

coupling said sensor to said processor;

connecting said disinfecting means to said processor to receive commands from said processor;

deploying a multitude of the covered bollard tubes in said area;

monitoring said area continuously with said sensor;

collecting samples of air in proximity to said covered bollard for analysis;

detecting and analyzing contents of a sample as containing an airborne agent;

providing a sensor input identifying a particular biochemical airborne agent in said sample through said transceiver, said sensor input further comprising an identification of an airborne agent, a measure of airborne agent potency and a type and quantity of disinfectant needed;

receiving said sensor input in said processor;

providing a control station transceiver for said control station to communicate with said circuit;

notifying personnel via said control station of the detection of an airborne agent; and sending a command from said processor to said disinfecting means to provide a countermeasure based on said previous identification by spraying chemicals to reduce or eliminate the airborne agents in real-time.

* * * * *